United States Patent [19]

Lichtenwald

[11] 4,064,670

[45] Dec. 27, 1977

[54] RAINPROOF LOUVER

[75] Inventor: Roger A. Lichtenwald, Perrysburg, Ohio

[73] Assignee: American Warming and Ventilating Inc., Toledo, Ohio

[21] Appl. No.: 729,166

[22] Filed: Oct. 4, 1976

[51] Int. Cl.[2] ..... E08B 7/08

[52] U.S. Cl. ..... 52/473

[58] Field of Search ..... 52/473, 97, 209; 98/121 R

[56] References Cited

U.S. PATENT DOCUMENTS

| | | | |
|---|---|---|---|
| 3,287,870 | 11/1966 | Johnson | 52/473 |
| 3,782,050 | 1/1974 | Dowdell et al. | 52/473 |

*Primary Examiner*—Price C. Faw, Jr.
*Assistant Examiner*—Carl D. Friedman
*Attorney, Agent, or Firm*—Henry K. Leonard

[57] ABSTRACT

A substantially rain-proof louver for mounting in an outside wall of an enclosure. The louver has a perimeter frame and plurality of blades extending across the frame, the blades being upwardly inclined from the outer edges to their inner edges. Each of the blades has a gutter element extending along its outer, lower edge. The gutter element is defined by the lowermost portion of the blade, a vertical flange and a downwardly and inwardly inclined anti-splash lip at the upper edge of the vertical flange, the anti-splash lip overlying, at least in part, the lowermost portion of the blade and extending toward the blade.

7 Claims, 11 Drawing Figures

RAINPROOF LOUVER

FIELD OF THE INVENTION

This invention relates to what variously have been called weather-proof louvers or rain-proof airflow louvers which are installed in the walls of buildings or other enclosures or at the ends of ducts to provide for ingress or egress of air through the louvers and yet to restrain or resist the passage of water from rain storms through the louvers and into the interiors of the enclosures.

THE PRIOR ART

Many louvers of the general type to which the invention relates have been developed and are used at the weather ends of both air intake and air exhaust ducts, or simply as air admitting openings. Examples of such louvers are shown in Great Britain Patent No. 341,556, in Johnson U.S. Pat. No. 3,287,870, and in Dowdell et al, U.S. Pat. No. 3,782,050.

In all of the mentioned patents, each of the louvers consists of a plurality of individual, vertically spaced blades or vanes, the blades in each case being inclined upwardly and inwardly with their lower horizontal edges at the outer sides of the louvers and their inner horizontal edges at the inner sides of the louvers, outer and inner, respectively, referring to the exterior side of the building wall or enclosure which is exposed to the weather and to rainfall and inner meaning the side remote from the exterior.

Similarly, in all three of these prior art disclosures, each of the blades has an upwardly turned lip at its upper inner edge to prevent waterflow thereover, and each of them has a water accumulating trough or lip at its lower outer edge to serve as a gutter for the accumulation of water flowing down the respective blade after impingement against the blade surface or captured by its upper flange. In all of these louvers of the prior art, the flowing air is deflected by the inclined vanes and, in theory at least, the heavier drops of water do not remain in the air stream but impinge against and are captured by the louver vanes, run down the vanes by gravity into the gutters, and are carried away.

In both U.S. Pat. Nos. 3,287,870 and 3,782,050, already mentioned, the gutter-like elements at the lower outer edges of the blades communicate with drainage means located at one or both ends of the blades, the drainage means functioning as down spouts into which the accumulated water in the gutter elements flows, and from which it is carried away by other ducting or gutter means. In some instances the water which had accumulated in the gutters and which had flowed down the downspout means is simply allowed to flow over an opened lower edge of a bottom of the louver construction and down the exterior of the wall of the building or enclosure.

While the louvers of all three of the prior art patents mentioned have been moderately successful in achieving their objective, i.e., in reducing the volume of water which is carried through the louvers into the interior of the building or enclosure or into the duct connected to the inner side of the louver, test results indicate that when air flows reach certain relatively high velocities large volumes of water actually are carried through such louvers.

SUMMARY OF THE INVENTION

The present invention consists of a substantially rainproof, air-flow louver comprising a plurality of inwardly and upwardly inclined individual louver blades, each of the blades having a lip at its upper inner edge for preventing the flow of water thereover, and each of the blades having a gutter element at its lower outer edge for the accumulation of water, the gutter elements being connected to downspout means similar, in general, to those of the prior art. However, the instant invention has an improved configuration in its gutter element which has been found by test to very greatly reduce the volume of water carried through the louver, particularly by inhibiting or substantially preventing drops of water dripping from upper blades which are deflected inwardly by the air flowing between the blades, from splashing into pools of water accumulated in the gutter elements of lower blades.

In addition, a louver embodying the invention departs dramatically from the underlying concepts of some of the prior art in that it is so designed as to deemphasize the creation of laminar air flow between adjacent louver blades which has been found to result in retention in the air flow of light weight moisture droplets and the resulting passage thereof through the louver.

BRIEF DESCRIPTION OF THE DRAWINGS

The attached drawings illustrate the construction of the aforementioned U.S. Patents to Johnson and Dowdell, et al, the figures thus illustrating these constructions being indicated by the legend "PRIOR ART" and the figures also include a full disclosure of the significantly different design and construction of a louver according to the invention with graphic demonstration of the improved results accruing therefrom.

DISCUSSION OF THE PRIOR ART ILLUSTRATED

Figure 1:
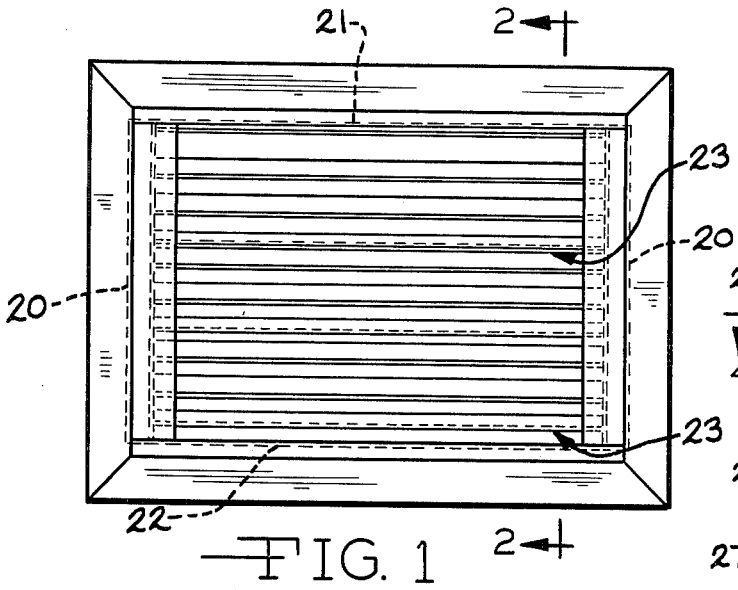
FIG. 1 is a front view in elevation of a louver of the type generally referred to herein, being particularly similar to FIG. 1 of Johnson, U.S. Pat. No. 3,287,870 although not clearly differentiating between the blade configurations of the prior art and that of the instant invention.

Louvers of the type generally referred to herein have frames comprising vertical side channels or jambs 20, a head channel 21, and a sill 22. A plurality of individual, vertically spaced blades 23 extends across between the jambs 20, each of the blades being upwardly and inwardly inclined from its outer side 24 toward its inner side 25. Such blades usually have return lips 26 extending along their upper inner edges which function to prevent the flow of water over the upper inner edges.

Figure 2:
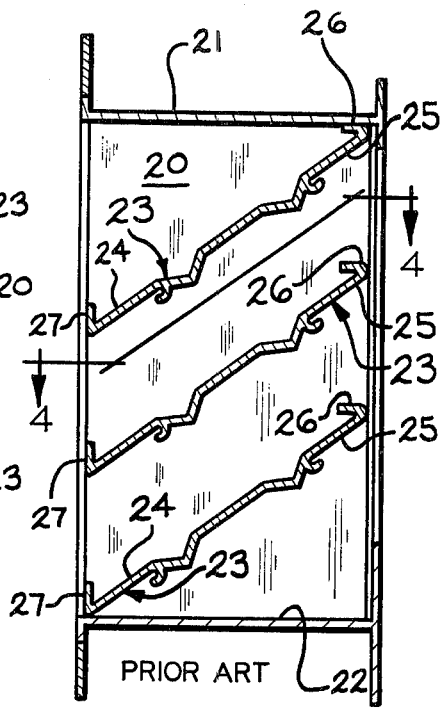
FIG. 2 is based upon FIG. 2 of the said prior art Johnson Patent, being taken in vertical section along the position indicated by the line 2—2 of FIG. 1.

The blades 23 as illustrated in FIG. 2 are shown according to the teaching in the Johnson Patent and each of them has a vertical flange 27 extending along its lower, outermost edge. The outer sides of the blades 23 are shown in much larger scale in FIG. 7 where it also can be seen that the side 24 and flange 27 form a gutter element in which water accumulates during a rainstorm and as it flows down the faces of the blades 23, the water thus accumulated being indicated in FIG. 7 as an elongated pool 28. Such a pool would continuously be present during a heavy rainfall in the same fashion as the gutters in a city street often have several inches of water present even though the sewer drains at the corners are there.

Figure 3:
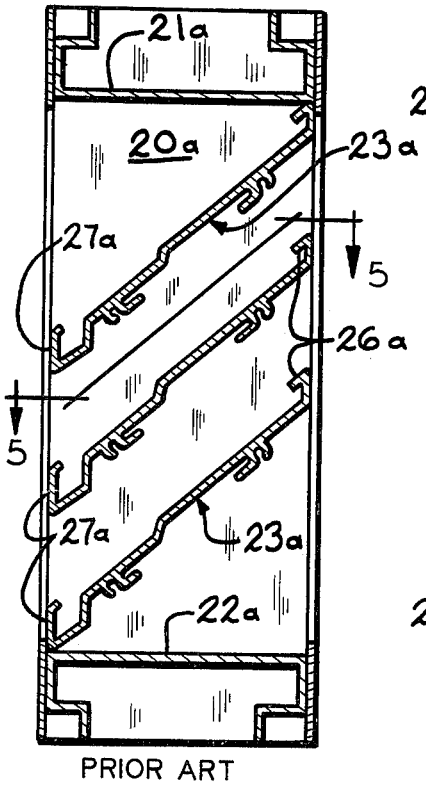
FIG. 3 is a view similar to FIG. 2, again taken substantially from the position indicated with the line 2—2 of FIG. 1 but is based upon a portion of FIG. 2 of the aforementioned Dowdell, et al, U.S. Pat. No. 3,782,050 illustrating the blade configuration of that patent.
Figure 4:
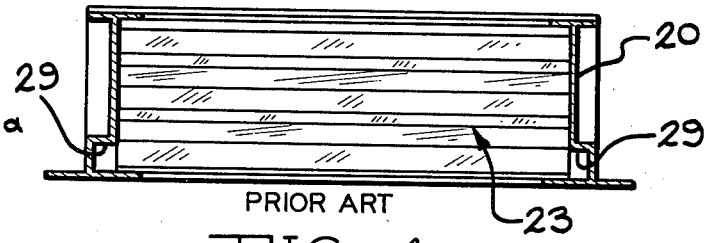
FIG. 4 is a fragmentary horiziontal sectional view taken along the line 4—4 of FIG. 2.
Figure 5:
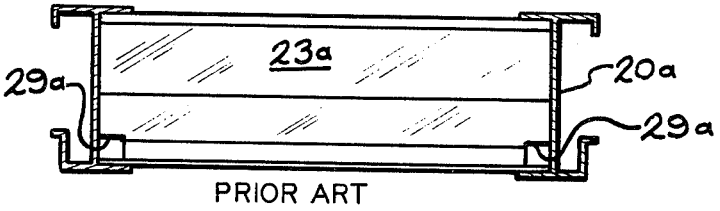
FIG. 5 is a horizontal sectional view taken along the line 5—5 of FIG. 3.

Similarly, a louver according to the Dowdell Patent, as illustrated in that patent and shown in FIGS. 3 and 5 hereof, comprises a plurality of inclined blades **23*a* each of which has a lip 26*a* extending along its upper inner edge and a vertical flange 27*a*** extending along its lower outer edge.

Figure 8:
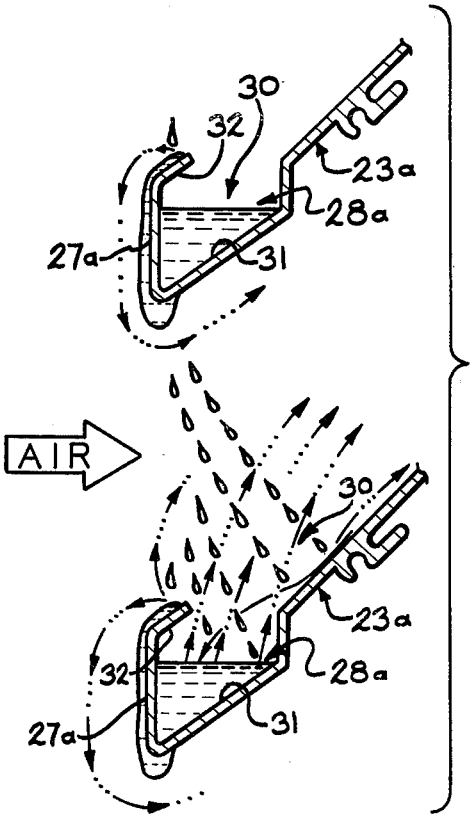
FIG. 8 PRIOR ART

As best can be seen by reference to FIG. 8, the blades **23*a* of the Dowdell Patent have troughs 30 which are formed or defined by offset bottom sides 31, the vertical flanges 27*a*, and overhanging lips 32**.

As is most clearly shown in FIG. 5 of the drawings, the louver construction of the mentioned Dowdell Patent also has downspout means **29*a*, in this case consisting of drain apertures cut in the ends of the troughs 30, one above the other, so that water flowing along the troughs 30 is delivered downwardly through the downspout means 29*a* adjacent the jambs 20*a* either to the sill 22*a*** or to the outer surface of the enclosure or building wall, as the choice may be.

Figure 7:
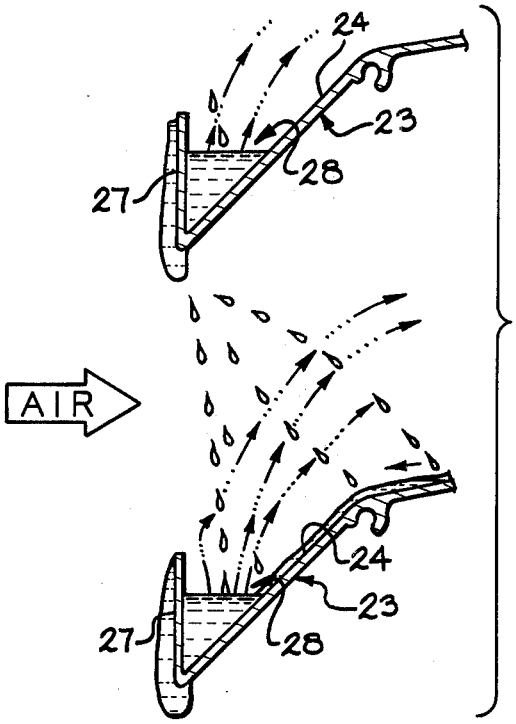
FIG. 7 PRIOR ART
FIGS. 7 and 8, respectively, are greatly enlarged, fragmentary, somewhat diagramatic views of the outer lower edges of two superposed blades of Johnson and Dowdell Patents; respectively, showing their gutter elements in detail, and in which observed action of water flow and water droplets are illustrated.

The constructions illustrated in FIGS. 2–5 inclusive, and FIGS. 7 and 8 all are prior art relative to the improved louver and louver blade of the instant invention. The mentioned British Patent No. 341,556 of 1931 is generally similar to that of the Dowdell Patent as shown in FIG. 8, for example, with the exception that the British construction does not show the return lips 32 of the Dowdell construction.

As in the case of the blades 23 (FIG. 7) a pool of water indicated by the reference number 28 is present in each of the troughs or gutter elements 30 during a heavy rainstorm by the accumulation of water flowing down the blades **23*a* and being blown through the vertical spaces between the blades 23*a* just as in the case of the blades 23 of FIG. 7** as taught in the Johnson Patent.

The problem existing in the construction of the two prior art patents to Johnson and Dowdell can best be understood be reference to FIGS. 7 and 8 in the following discussion.

When heavy rainfall impinges against the outside of a building and, thus, against the face of a louver of the type herein discussed, some of the rain accumulates as a surface layer on the building wall above the head channel 21 and runs down its face as well as accumulating on and running down the faces of the flanges 27 or **27*a* on the lower outer sides of the louver blades 23 or 23*a*. In FIGS. 7 and 8 an attempt has been made to indicate this film of water flowing down the outer face of a flange 27 in the upper one of a pair of blades 23 and dropping toward the pool 28 in the lower one of the blades 23. As diagramatically shown, some of the rain drops thus falling down will drop almost vertically; some of them will flow along with the air flowing through the space between the adjacent blades; some of them will impinge against the upper surface of the next lower one of the blades 23 and flow back down that surface to re-enter the pool 28; some of the drops will fall downwardly into pool 28 where they will splash, throwing up fragmented, smaller drops of less mass in the form of what might be called a fine mist. With a substantial air flow through the space into which this mist is then projected by the splashing, the mist is picked up and carried along with the air as the air flows into the interior of the enclosure or duct. The foregoing explanation is based upon careful observation of tests of a louver according to the Johnson Patent as illustrated in FIG. 7 and a similar test of a louver according to the Dowdell Patent as illustrated in FIG. 8**.

In both FIGS. 7 and 8 an attempt has been made to show larger drops of water by teardrop shapes and the smaller splashed, resulting mist by small circular shapes with arrows indicating their directions of flow.

It will be observed in both FIGS. 7 and 8 that a large area of the respective pools 28 and **28*a*** is open vertically for the direct entry and impingement of water droplets into the surfaces of the pools.

It is believed that the mist creating tendency of louver blades as shown in FIG. 8 is even greater than that of louver blades as shown in FIG. 7. Not only is there the direct impingement of the falling drops of water into the pool **28*a* but some of those drops of water impinge upon the upper surface of the lips 32 and splash, creating a mist which flows downwardly by gravity and then is swept around and into the space between the respective blades where the air flow is likely to carry it along through the spaces between the blades 23*a*** and into the interior of the enclosure or duct allegedly being protected by the louver.

As mentioned earlier, the problem of the mist being carried through the louver by the air flowing between the blades is particularly present in a louver designed according to the Dowdell Patent because of its emphasized so-called laminar flow which Dowdell claims is desirable in that it reduces turbulence in the spaces between the blades. However, as will be further explained, it is believed that this concept is directly contrary to best practice and the instant invention deliberately abandons this part of the Dowdell teachings and is contradictory thereto.

While the foregoing visual observations demonstrated the creation of the mist of fine water particles and their entrainment in the air flowing through, the actual fact of substantial entrainment and penetration was made apparent in the published literature of the Assignee Company of the Dowdell Patent. This literature reproduced graphs of water infiltration in ounces in 15 minutes versus the velocity in feet per minute through the face area of a louver having a face area of 48 inches by 48 inches (16 square feet) at a 4 inches per hour simulated rainfall rate. The test depicted in this published literature was performed at the laboratories of the Air Moving & Conditioning Assocation, Inc. according to their test procedures. These data and curves illustrating these data were published by Dowco Corporation, Assignees of the aforesaid Dowdell, et al, U.S. Pat. No. 3,782,050 on page 10.26 DOW of their leaflet which is a part of the 1975 "Sweet's Catalog" (Volume 10) published by Sweet's Division, McGraw-Hill Information Systems Company, New York.

Figure 11:
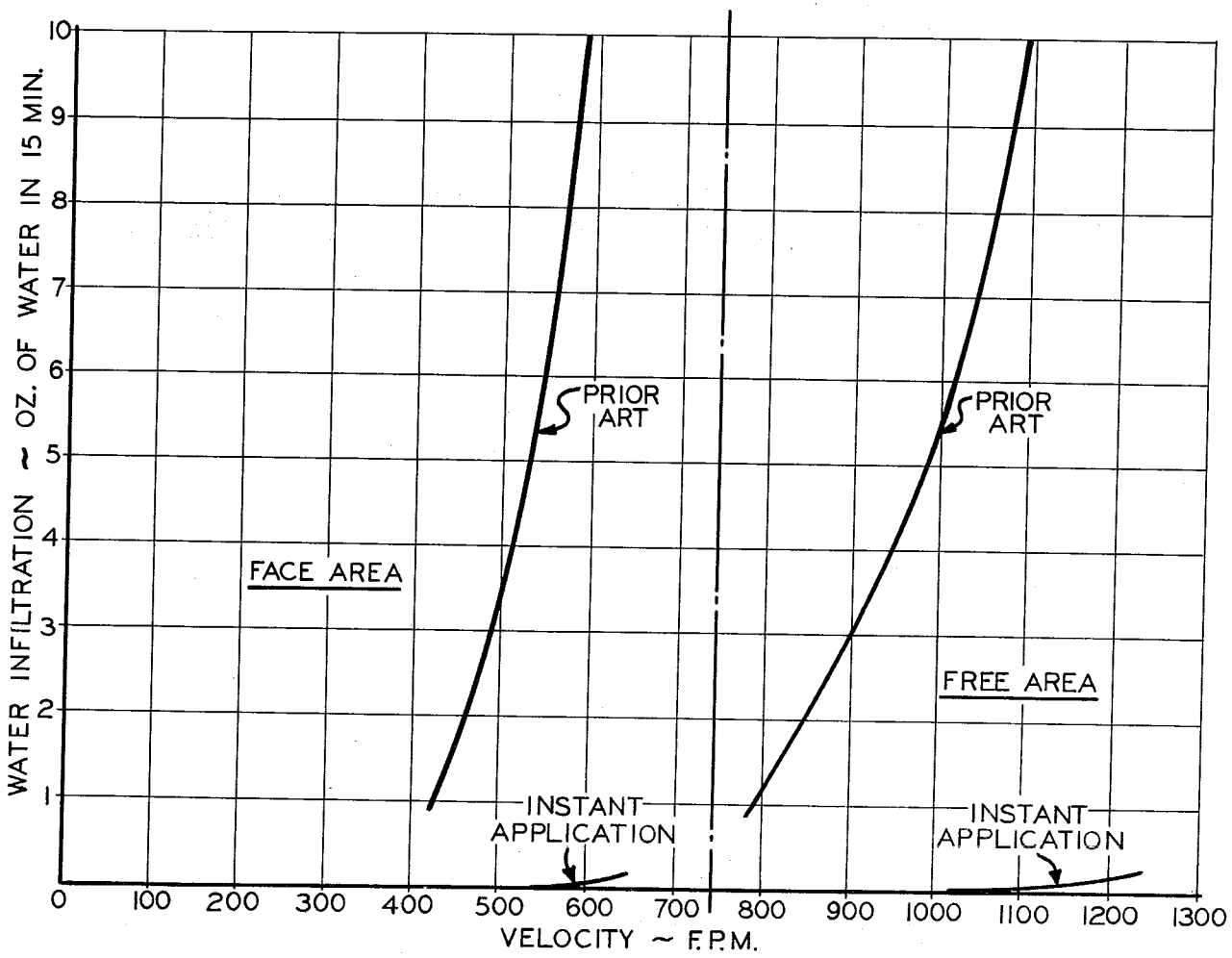
FIG. 11 is a graph plotting the test results as shown in published information concerning a louver according to Prior Art Dowdell Patent and contrasted to test information of the same type concerning a louver fabricated according to the instant invention.

The data establishing the curve identified as "DBE" have been reproduced in FIG. 11 of the drawings of the instant case in two ways, as penetration through the "face area" and as penetration through the "free area," both curves referring to the data from the insert in the Sweet's Catalog being labeled "PRIOR ART." The curves shown and thus labeled for a louver 6 inches thick from front to back or, in other words, measuring 6 inches from the left side of FIG. 3 to the right side thereof. It will be realized, of course, that in a louver which measures 6 inches from its front to its back the linear length of the individual blades, such as the blades 23*a* of FIG. 3, is approximately 7½ inches.

DESCRIPTION OF PREFERRED EMBDOIMENTS

Figure 6:
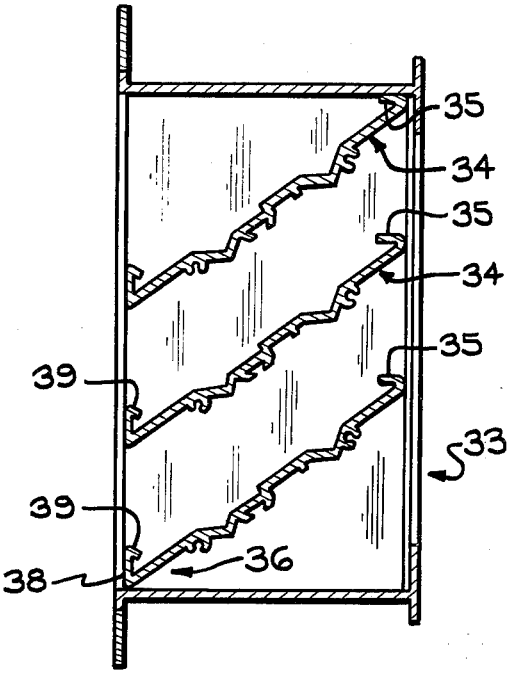
FIG. 6 is a view similar to FIGS. 2 and 3 but showing the improved blade embodying the instant invention.

A louver according to the instant invention is generally indicated in FIG. 6 by the reference number 33 and, like those of the prior art, comprises a plurality of individual blades 34 mounted and arranged in the same fashion in which such blades are mounted and arranged in the prior art, for examples, the Johnson and Dowdell Patents referred to above.

Each of the blades 34 (FIGS. 6 and 9) or modified blades 34*a* (FIG. 10) has a gutter element 36 or a trough 37 extending along its lower outer edge.

Figure 9:
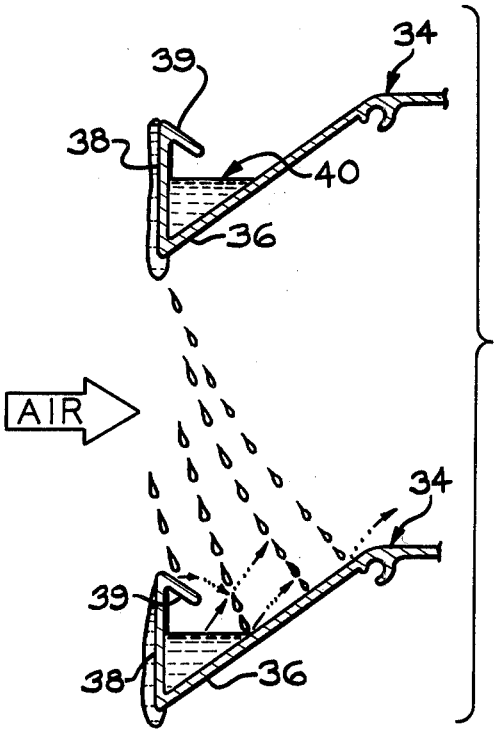
FIG. 9 is a view similar to FIGS. 7 and 8 but illustrating one modification of a louver blade and the gutter element thereof according to the invention.

In the embodiment of the invention illustrated in FIGS. 6 and 9 the gutter element 36 is formed by an outer portion of the blades 34, a vertical flange 38 and an inwardly and downwardly extending anti-splash lip 39. As in the prior art, when rain strikes the louver some of the raindrops impinge against the outer sides of the flanges 38, flow down those flanges and drop off. Other raindrops are blown inwardly by the air stream and either impinge upon the upper surface of the blade 34, itself, or strike the inwardly turned anti-splash lip 39 or (a few) may fall directly into a pool 40 which accumulates in the gutter element 36 just as the pool 28 accumulates in the construction illustrated in FIG. 7.

However, in sharp and important contrast to the functioning of the structure illustrated in FIG. 7 according to the Johnson Patent, the tendancy for any of the water to flow through the louver and to pass to the interior of the enclosure or duct is greatly reduced by the configuration of the louver blades according to the invention. As is somewhat diagramatically illustrated in FIG. 9, the area of the pool 40 which is exposed to falling drops is greatly reduced when compared to the area of the pool 28 as illustrated in FIG. 7. Secondly, such drops as might otherwise fall into the outermost portion of the pool 40 instead impinge against the downwardly and inwardly inclined anti-splash lip 39 whence they are deflected downwardly again at reduced velocity and are less likely to cause splashing and thus the generation of mist which would flow through the louver.

Figure 10:
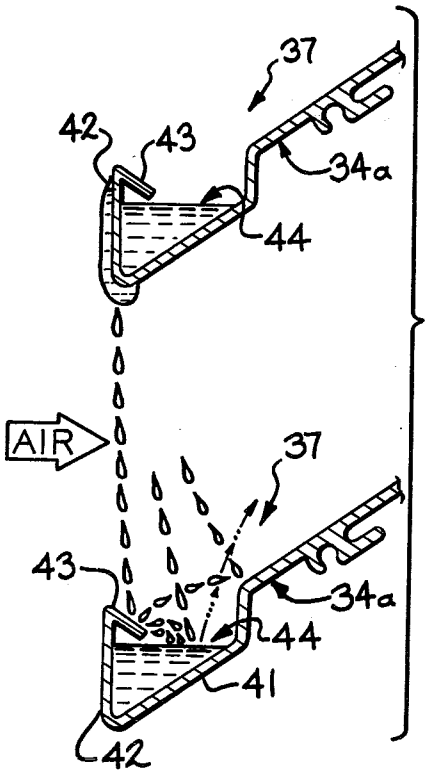
FIG. 10 is a view similar to FIG. 9 illustrating the gutter element of a louver blade generally configured according to the Dowdell Patent, as modified according to the instant invention.

The embodiment of the invention illustrated in FIG. 10 exhibits the same improvements over the louver blade construction illustrated in FIG. 8 as disclosed in the Dowdell, et al Patent discussed above and has an additional improved feature relative to the construction of FIG. 8. In FIG. 10 the louver blade 34*a* has a trough 37 defined by an offset portion 41 comparable to the offset portion or trough bottom 31 of FIG. 8, and a vertical flange 42 comparable to the vertical flange 27*a* of FIG. 8. However, in lieu of the upwardly inclined lip 32 of the construction of FIG. 8, that of FIG. 10 has an inwardly and downwardly directed anti-splash lip 43 according to the invention.

Therefore, as can best be appreciated by comparison between FIGS. 8 and 10, the incidence of splashing and the generation of fine mist which is entrained with the inflowing air is greatly reduced. Raindrops which impinge upon the anti-splash lip 43 are not deflected outwardly and around the flange 42 to re-enter the air stream as they are in the construction illustrated in FIG. 8. Some raindrops are deflected from the surface of the blade itself and engage the anti-splash lip 43 and then are deflected at lesser velocity into the pool 44 where the splashes they create are much smaller.

Again, the foregoing comments are based upon visual observation of the operation of louvers under standard test conditions when equipped with blades according to the invention and constitute an effort to explain the reason for the dramatic contrasts now to be discussed.

In performing the tests of louvers embodying the instant invention in order to assemble data comparable to the data reported in the mentioned publication with respect to louvers embodying the Dowdell Patent mentioned above, particularly the DOWCO DBE 6-inch louver, a louver having a 48 inch by 48 inch (16 square foot) face area was constructed employing louver blades such as those illustrated in FIGS. 6 and 9. The blades were set at approximately the same angle as the DOWCO blades — 35° - 40° from horizontal. The simulated rainfall of 4 inches per hour was the same. The various velocities through the face area in feet per minutes were the same. All other test conditions were duplicated under the auspices of the testing laboratory at the Air Moving & Conditioning Association, Inc. Every effort was made to test louvers according to the invention as nearly similar to the louvers referred to in the mentioned publication as possible.

As readily can be seen, in the two sets of comparable curves set forth in FIG. 11, water infiltration in response to higher air flow in the case of the prior art louver embodying the mentioned Dowdell, et al Patent, increased dramatically whether plotted against the face area of the louver or the free area. The two curves labeled "PRIOR ART" show that as the velocity of the air in feet per minute increased from slightly more than 400 to slightly less than 600, water infiltration plotted against the face area increased from slightly less than one ounce in 15 minutes to almost 10 ounces in 15 minutes.

In astonishing contrast, the water infiltration through a louver embodying the instant application plotted against the face area was virtually imperceptible until a velocity in excess of 500 feet per minute was reached and increased only to a fraction of an ounce when the velocity reached 650 feet per minute.

Similarly, when the water infiltration versus the free area was plotted according to the published data referred to above, water infiltration at 800 feet per minute was about 1 ounce and increased dramatically to somewhere in the order of 10 ounces when the velocity reached the level of 1100 feet per minute. Again, in sharp and astonishing contrast in the louver according to the instant invention, water infiltration was virtually imperceptible until the velocity of the air reached 1000 feet per minute and increased to only a fraction of 1 ounce in 15 minutes when the velocity reached a level of over 1200 feet per minute.

The unexpected and astonishing improvement can only result from the change in construction made apparent by comparing the cross section of FIG. 9 with that of FIG. 8. The difference between the curves adjacent each other in that portion of FIG. 11 labeled "face area" and the curves adjacent each other in that portion of FIG. 11 labeled "free area" cannot be explained in any other fashion since all other test parameters, i.e., area, velocity, blade angle, louver depth, simulated rate of rainfall, test time, etc. were substantially identical.

Having described my invention, I claim:

1. In a multiple-blade, substantially rainproof, air flow louver, having a perimeter frame and a plurality of individual, vertically spaced blades extending horizontally across between elements of said frame, and drainage means at at least one end of each of said blades, the improvement consisting of specially configured blades, said blades being positioned with their outer horizontal edges at a level lower than their inner horizontal edges, the main surfaces of said blades extending between said outer and inner edges being interrupted with upward and inward water-flow retarding configurations, the inner-upper edges of said blades having outwardly extending return lips for preventing water flow thereover inwardly thereof, and the outer-lower edges of said blades having water receiving gutter elements communicating with said drainage means at at least one end thereof, each of said gutter elements consisting of a bottom, a vertical flange at the outermost edge of said bottom, and an inwardly extending anti-splash lip at the upper edge of said vertical flange, said lip extending downwardly at an acute angle toward the main surface and overlying said gutter element a sufficient distance substantially to eliminate impingement of water drops from superior blades into said gutter element.

2. A louver according to claim 1 in which the bottom of the gutter element is a part of the main surface of the blade.

3. A louver according to claim 1 in which the bottom of the gutter element is offset from the main surface of the blade.

4. A louver according to claim 1 in which the angle between the anti-splash lip and the vertical flange is substantially equal to the angle between the vertical flange and the bottom of the gutter element.

5. A louver according to claim 1 in which the main surface of the blades lie at an angle of approximately 35° - 40° from horizontal and the anti-splash lip extends toward said main surface at an angle of approximately 70° - 80°.

6. A louver according to claim 1 in which the anti-splash lip extends from the upper edge of the flange toward the main surface a distance equal to approximately one half of the distance therebetween.

7. A louver according to claim 1 in which the anti-splash lip extends over the gutter at an angle relative to the angle of mounting the blades and to the vertical flange such that water drops falling from the lower most edge of a next upper blade which are blown inwardly by air flow through said louver are deflected by said anti-splash lip inwardly thereof beyond accumulated water in the gutter, thereby eliminating splashing of such dropping water into such accumulated water.

* * * * *